US006722533B2

(12) United States Patent
Skillern

(10) Patent No.: US 6,722,533 B2
(45) Date of Patent: Apr. 20, 2004

(54) HYDRATION POUCH WITH DETACHABLE HOSE

(76) Inventor: Jeff Skillern, 121 Horizon Cir., Boise, ID (US) 83702

( * ) Notice: Subject to any disclaimer, the term of this patent is extended or adjusted under 35 U.S.C. 154(b) by 157 days.

(21) Appl. No.: 10/085,626

(22) Filed: Feb. 26, 2002

(65) Prior Publication Data

US 2003/0160065 A1 Aug. 28, 2003

(51) Int. Cl.[7] ..... B67D 5/64
(52) U.S. Cl. ..... 222/175; 222/529
(58) Field of Search ..... 222/146.6, 175, 222/529

(56) References Cited

U.S. PATENT DOCUMENTS

| | | | |
|---|---|---|---|
| 4,082,208 | A | 4/1978 | Lane, Jr. |
| 4,090,650 | A | 5/1978 | Gotta |
| 4,193,518 | A | 3/1980 | Holmes |
| 4,196,817 | A | 4/1980 | Moser |
| 4,344,303 | A | 8/1982 | Kelly, Jr. |
| 4,368,766 | A | 1/1983 | Nomi |
| 4,420,097 | A | 12/1983 | Motsenbocker |
| 4,526,298 | A | 7/1985 | Boxer et al. |
| 4,530,220 | A | 7/1985 | Nambu et al. |
| 4,812,054 | A | 3/1989 | Kirkendall |
| 4,815,635 | A | 3/1989 | Porter |
| 4,852,781 | A | 8/1989 | Shurnick |
| 4,932,225 | A | 6/1990 | Bighouse |
| 4,948,023 | A | 8/1990 | Tripp |
| 4,955,516 | A | 9/1990 | Satterfield |
| 4,981,022 | A | 1/1991 | Snyder |
| 5,024,067 | A | 6/1991 | Maier, II |
| 5,035,122 | A | 7/1991 | Oogjen |
| 5,052,725 | A | 10/1991 | Meyer et al. |
| 5,060,833 | A | 10/1991 | Edison et al. |
| D321,980 | S | 12/1991 | Billet |
| 5,085,349 | A | 2/1992 | Fawcett |

(List continued on next page.)

OTHER PUBLICATIONS (Spring 2000) Performance Bicycle Catalogue, pp. C4, 36–38.

Gregory Mirage Catalogue (1998) p. 23–24.

Gregory Mirage Catalogue (1998) p. 29.

*Primary Examiner*—Philippe Derakshani
(74) *Attorney, Agent, or Firm*—Bozicevic, Field & Francis LLP; Frank Becking

(57) ABSTRACT

A hydration pouch with a releasable coupling is disclosed. The hydration pouch is a flexible bag or pouch with a separate inlet and outlet. A hose or tube is provided for a user to draw refreshment from the pouch. A valve is provided at one end of the tube. Closer to the pouch, or at the pouch itself, a coupling is provided for attaching and detaching at least a portion of the hose. The coupling includes a shutoff or check valve in order to maintain the patency of the pouch when the hose is disconnected. Upon engaging the portions of the coupling, fluid within the pouch is able to feed into the tube. In use, the pouch is generally housed in a backpack. By actuating the coupling, the pouch alone may be removed for refill, chilling or cleaning—leaving the hose behind so it does not also have to be refit in the pack the next time around.

6 Claims, 3 Drawing Sheets

U.S. PATENT DOCUMENTS

| | | | |
|---|---|---|---|
| 5,104,159 | A | 4/1992 | Sugiyama et al. |
| 5,119,978 | A | 6/1992 | Kalamaras et al. |
| 5,129,238 | A | 7/1992 | Schwartz et al. |
| 5,282,557 | A | 2/1994 | McCook |
| 5,301,858 | A | 4/1994 | Hollander |
| 5,398,848 | A | 3/1995 | Padamsee |
| 5,400,934 | A | 3/1995 | Ducros |
| 5,427,290 | A | 6/1995 | Thatcher |
| 5,431,308 | A | 7/1995 | Tchen |
| 5,456,090 | A | 10/1995 | McCoy |
| 5,490,396 | A | 2/1996 | Morris |
| 5,597,087 | A | 1/1997 | Vinarsky |
| 5,607,087 | A | 3/1997 | Wery et al. |
| 5,722,573 | A | 3/1998 | Carnel |
| 5,727,714 | A | 3/1998 | Fawcett |
| 5,755,368 | A | 5/1998 | Bekkedahl |
| D396,630 | S | 8/1998 | Lerner |
| 5,806,726 | A | 9/1998 | Ho |
| 5,816,457 | A | 10/1998 | Croft |
| 5,864,880 | A | 2/1999 | Adam |
| 5,904,267 | A | 5/1999 | Thompson |
| 5,911,406 | A | 6/1999 | Winefordner et al. |
| 5,940,880 | A | 8/1999 | Phillips |
| 5,941,640 | A | 8/1999 | Thatcher |
| 5,975,387 | A | 11/1999 | Gleason et al. |
| 6,032,831 | A | 3/2000 | Gardner et al. |
| 6,039,305 | A | 3/2000 | Hoskins et al. |
| 6,082,589 | A | 7/2000 | Ash et al. |
| 6,094,935 | A | 8/2000 | Stein |

HYDRATION POUCH WITH DETACHABLE HOSE

FIELD OF THE INVENTION

This invention relates to hydration systems, particularly passive hydration bladder type systems that find use in cycling and other out-door activity such as hiking, skiing or hunting.

BACKGROUND OF THE INVENTION

Numerous hydration systems have been conceived in effort to effectively and conveniently quench the thirst of cyclist and other athletes or hobbyist who need to pack or carry along a personal water supply. Many have chosen to abandon the trusty water bottle mounted in a cages attached to a bicycle frame or carried in a hip pack in favor of using a hydration pouch.

A popular class of hydration pouch products set a pouch in a backpack, whereby access to the liquid contents of the pouch are made available by a hose running from the base of the pouch to the mouth of a user. A bite valve is usually included at the end of the hose so the user can obtain refreshment without involving his or her hands. Examples of such system are disclosed in U.S. Pat. Nos. 4,420,097; 4,948,023; 5,085,349; 5,060,833; 5,282,557; 5,427,290; 5,727,714; 5,722,573; 5,806,726; 5,864,880; 5,911,406; 5,941,640; 5,975,387; 6,032,831 and 6,039,305.

Hydration pouches have gained acceptance for reason of the large volume of drinking fluid they may contain—as compared to a standard, or even oversized cycling water bottle. Of equal importance, however, is the manner in which hydration pouches carry the drinking fluid. Its flexible nature allows the load carried on the user's back to conform in shape and also for the pouch to collapse as the liquid volume is drained from it. Both these feature contribute to the comfort of its use.

In contrast, water bottles as used in cycling are substantially rigid. They may be compressed to squeeze out their contents, however, they return to shape. Most often, such bottles are generally cylindrical, as is convenient for their receipt within a common water bottle cage.

A hydration system with some features in common with those of the present invention is disclosed in U.S. Pat. No. 5,607,087 to Wery, et al. Here, a preasureizeable water bottle connected to a hose with a bite valve is disclosed. At the end of the hose opposite the bite valve, a quick-connect/disconnect coupling is provided. When disengaged, the portion remaining with the water bottle, which includes a check valve or shut-off valve prevents the escape of fluid and pressurized gas there from.

The system in the Wery, et al. patent requires charging of a water bottle with pressurized gas in order to force fluid from an elevation below the bite valve to the mouth of the user. The valve combination disclosed facilitates trading out one spent bottle for another for providing continued refreshment to the user.

A primary distinction between the Wery, et al. system and that of the present invention is that the present invention employs a flexible hydration pouch. It eschews the rigidity of the water bottle (which is made even more so in the device in the referenced patent due to the presence of pressurized gas therein) in favor of the compliant advantages offered by a "Camel Bak" type device.

While certain of such hydration pouch devices include removable hoses, none known of include a detachable hose with a check valve set to maintain the contents of the pouch upon removal of the hose. U.S. Pat. No. 5,803,726 to Ho merely discloses a hydration pouch with a hose that is attached (or may be removed) by way of a threaded coupling to the bag. Such a system does not allow for the advantages of the present invention as summarized below.

SUMMARY OF THE INVENTION

The present invention comprises a flexible hydration pouch, a hose or line attached thereto including a valve for actuation by a user to access fluid and a coupling member attaching the hose to the pouch, wherein the coupling member includes a shutoff or check valve holding fluid within the pouch when the hose is disconnected. Another valve may also be provided to hold fluid in the hose when portions of the coupling are disengaged. A portion of the coupling may be provided integrally with the pouch. Alternately, the coupling may be provided in-line with the hose.

Such a system offers is the ability to decouple a hose from a hydration bladder and leave it engaged with a backpack as typically used in connection with hydration pouches. The decoupled hydration pouch then may be refilled, chilled or otherwise attended to. Filling of the bag is feasible in view of the shutoff valve provided to maintain the contents of the pouch without the closure typically offered by a hose with a bite valve. Especially in connection with the ability to easily connect a heated or refrigerated pouch with a hose set in a pack, it is preferred to use a hydration pouch that integrally includes a thermal medium. In addition, the coupling/check-valve combination disclosed offers a potential for certain modularity. It allows a user to purchase only one hose and bite valve for use with any number of hydration pouches that may vary is size or features—such as integral cooling medium.

While any of these advantages are possible, it may be the case that only some or even none of them are made use of in connection with the present invention. Furthermore, those with skill in the art may appreciate other advantages not expressly mentioned herein.

Whatever the case, the present invention includes systems comprising any of these features described herein. Methodology described in association with the devices disclosed also forms part of the invention. The invention further comprises such hardware and methodology as may be used in connection with that described which is incorporated by reference.

BRIEF DESCRIPTION OF THE DRAWINGS

Each of the following figures provide examples diagrammatically illustrating aspects of the present invention. Variation of features of the invention and collateral equipment shown is contemplated.

DETAILED DESCRIPTION OF THE INVENTION

Before describing variations of the present invention in detail, first it is to be understood that this invention is not limited to particular variations set forth and may, of course, vary. Various changes may be made to the invention described and equivalents may be substituted without departing from the true spirit and scope of the invention. In addition, many modifications may be made to adapt a particular situation, material, composition of matter, process, process step or steps, to the objective, spirit and scope of the present invention. All such modifications are intended to be within the scope of the claims made herein. Furthermore, where a range of values is provided, it is understood that every intervening value, between the upper and lower limit of that range and any other stated or intervening value in that stated range is encompassed within the invention. The upper and lower limits of these smaller ranges may independently be included in the smaller ranges and is also encompassed within the invention, subject to any specifically excluded limit in the stated range. Where the stated range includes one or both of the limits, ranges excluding either both of those included limits are also included in the invention. Also, it is contemplated that any optional feature of the inventive variations described herein may be set forth and claimed independently, or in combination with any one or more of the features described herein.

Unless defined otherwise, all technical and scientific terms used herein have the same meaning as commonly understood by one of ordinary skill in the art to which this invention belongs. Although any methods and materials similar or equivalent to those described herein can also be used in practicing present invention, the preferred methods and materials are described. All existing subject matter mentioned herein (e.g., publications, patents, patent applications and hardware) is incorporated by reference herein in its entirety. The referenced items are provided solely for their disclosure prior to the filing date of the present application. Nothing herein is to be construed as an admission that the present invention is not entitled to antedate such material by virtue of prior invention.

Also, it is noted that as used herein and in the appended claims, the singular forms "a," "and," "said" and "the" include plural referents unless the context clearly dictates otherwise. Conversely, it is contemplated that the claims may be so-drafted to require singular elements or exclude any optional element indicated to be so here in the text or drawings. This statement is intended to serve as antecedent basis for use of such exclusive terminology as "solely," "only" and the like in connection with the recitation of claim elements or the use of a "negative" claim limitation(s).

Figure 1:
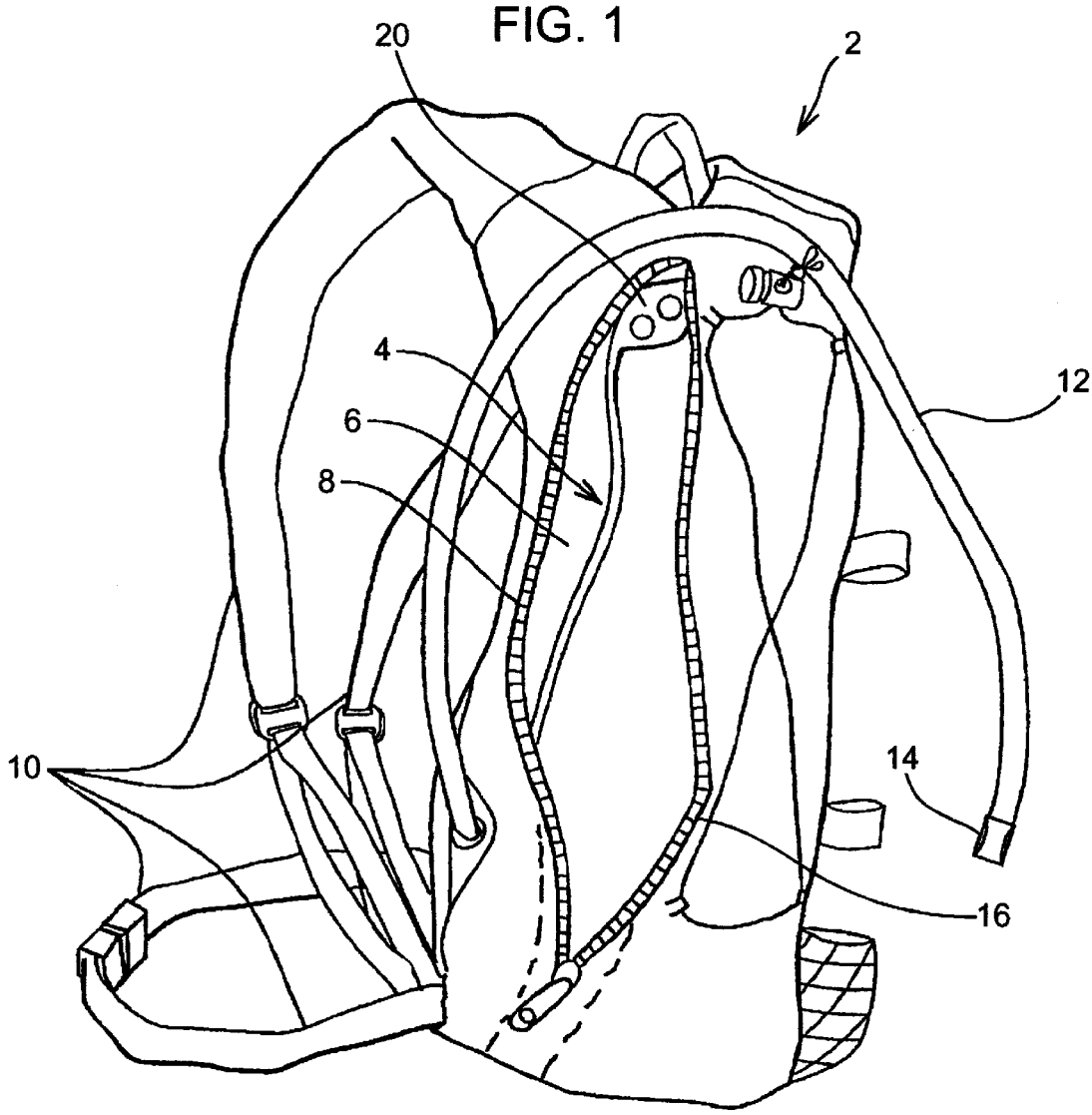
FIG. 1 shows an overview of a hydration system of use in the present invention.

Turning now to FIG. 1, the inventive system may include a pack 2 adapted to house a hydration pouch 4. Various manufacturers produce packs suitable for such use. Exemplary packs include those sold by K2 Bike (Vashon, Wash.), CamelBak (Weatherford, Tex.), Blackburn Designs (San Jose, Calif.), and Performance Bicycle Inc. (Chapel Hill, N.C.).

Pack 2 includes a housing portion 6 with an access zipper 8 and straps 10. Hydration pouch 4 is shown within the pack 2. The pouch 4 shown is fluidly connected to a conduit 12 including a valve 14 to prevent inadvertent draining of the pouch 4. Conduit 12 may be insulated. For instance a neoprene sleeve (not shown), such as produced by Lizards Skins (Pleasant Grove, Utah) may be used. Valve 14 is preferably a bite-valve articulable by the jaws of a user.

Figure 2B:
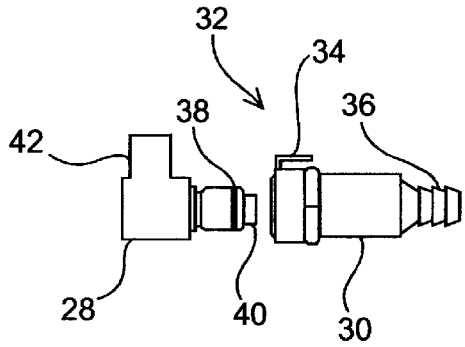
FIG. 2B is a close-up of the coupler in FIG. 2A.
Figure 2A:
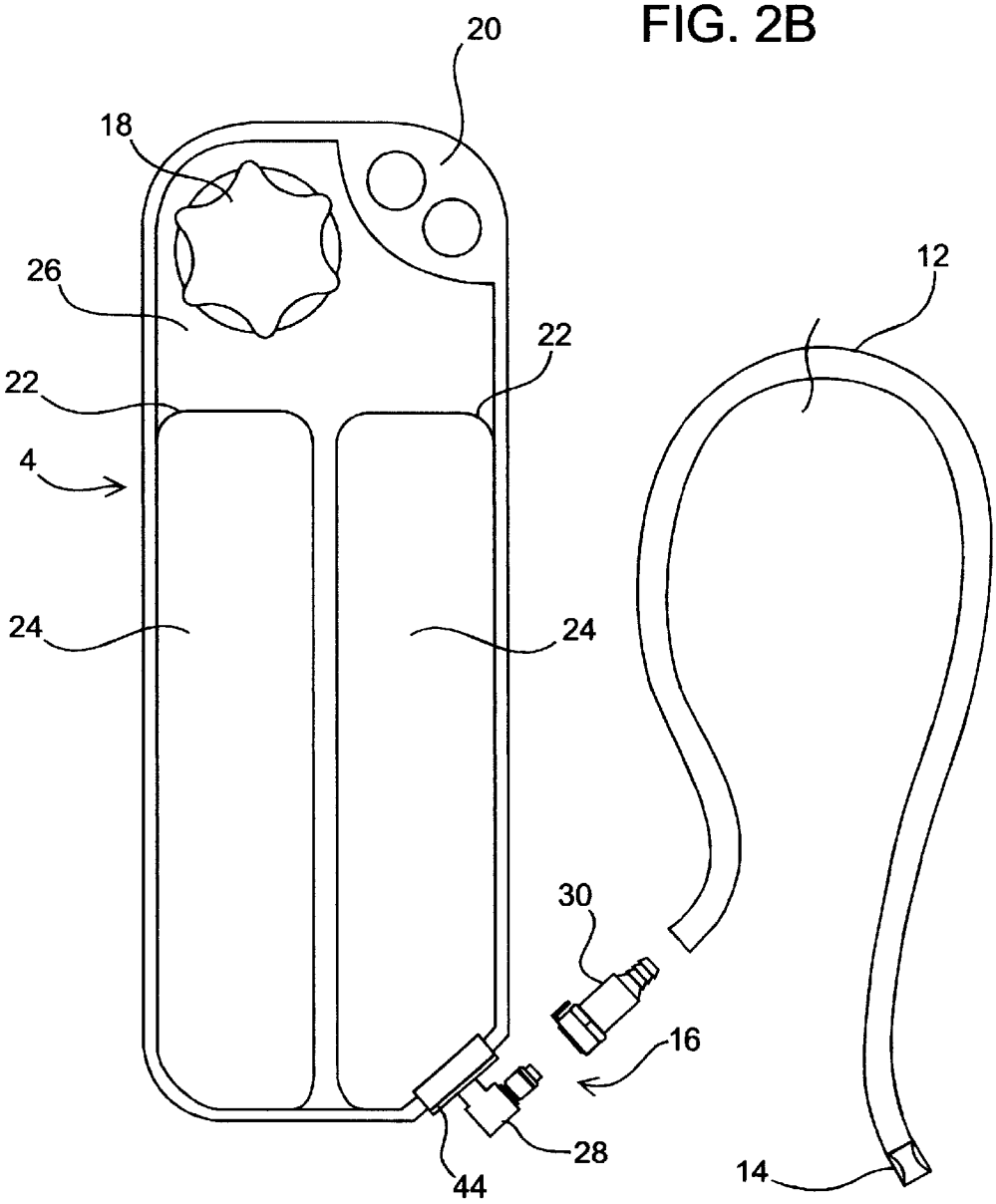
FIG. 2A shows a pouch including a hydration line coupler setup according to the present invention.
Figure 3B:
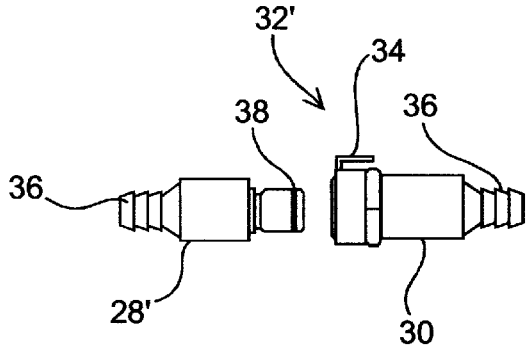
FIG. 3B is a close-up of the coupler in FIG. 3A.
Figure 3A:
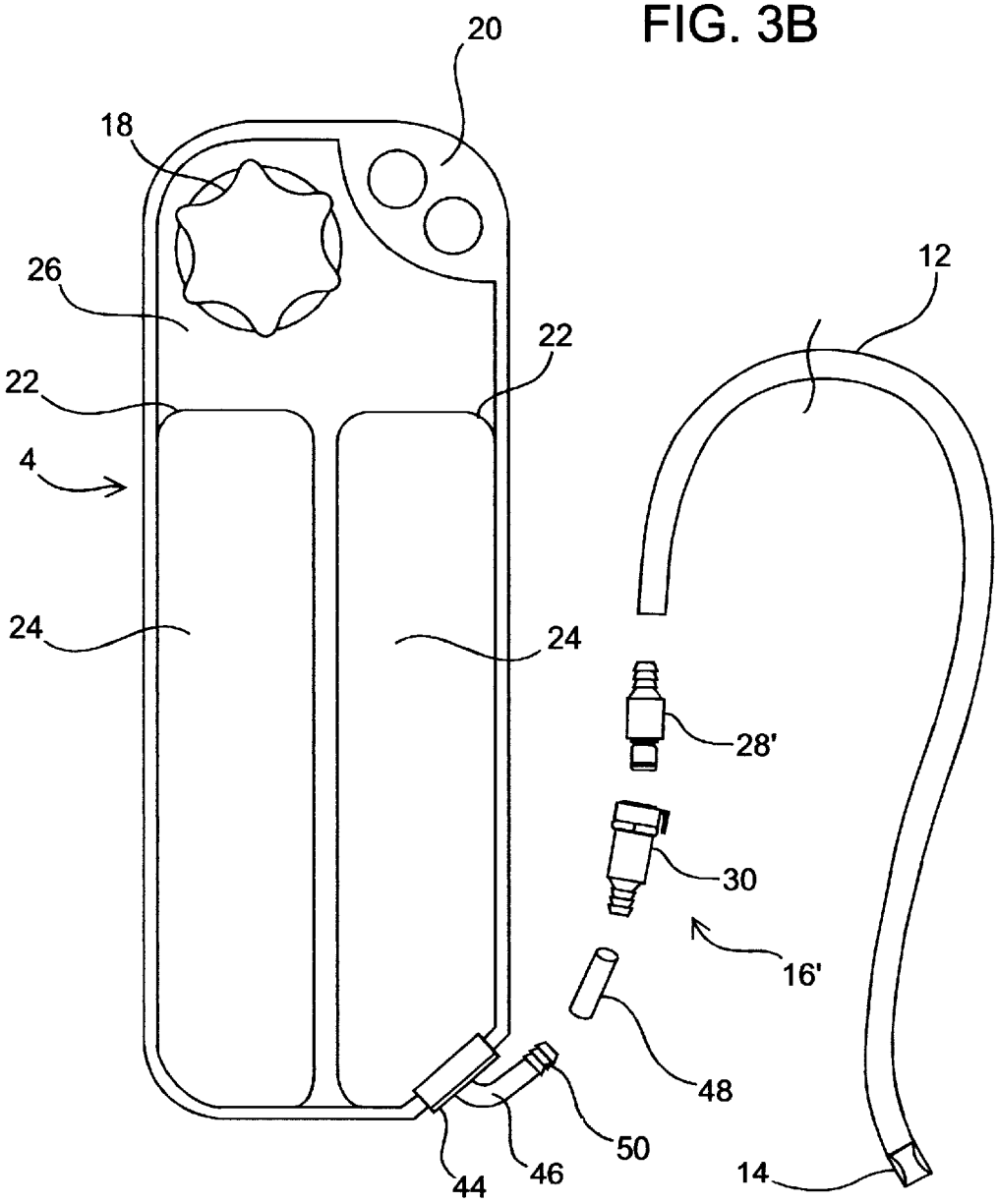
FIG. 3A shows a pouch including another hydration line coupler setup according to the present invention.

As shown in FIGS. 2A and 3A, the conduit 12 is connected to the pouch 4 via a fitting assembly 16 or 16'. The pouch includes a sealable opening 18 through which it may be filled. A screw-type cap is shown, although a snap or press-fit baffle or another structure may be provided. The pouch shown also includes a hanger section 20. The inlet of the conduit 12 is attached at a lower portion of the pouch 4 when it is to be utilized in conjunction with a backpack as shown in order to facilitate full evacuation of liquid from the pouch 4.

Portions of the pouch 4 intended to contact fluid for drinking preferably comprise such materials as commonly used in other flexible hydration bags, pouches, bladders or the like produced by companies such as Gregory Manufacturing Inc. (Holeyoke, Mass.) and Dielectrics (Chicopee, Mass.). Suitable materials include, but are not limited to polyethylene (sold as CXC material produced by Hyclone (Logan, Utah)), urethane, polyurethane, polystyrene, and nylon.

Pouch 4 including the connector features of the present invention may be utilized as part of a larger hydration system including a backpack or harness 2 or be used independent of such structure. Furthermore, any type of hydration bladder, such as various models presently sold by CamelBak, Pladapus or K2 may be used in connection with the present invention.

However, a pouch 4 including integral thermal capacitance medium as shown in FIGS. 2A and 3A from the front and in FIG. 1 from behind is most preferred. Suitable integrally cooled (or heated) hydration pouches are described in U.S. patent application Ser. No. 09/653,816 filed Sep. 1, 2000 and Ser. No. 10/043,657 filed Jan. 8, 2002 be used to the present inventor. As shown in FIGS. 2A and 2B, pouch 4 includes adjacent pockets 22 filled with a thermal capacitance medium 24.

The thermal medium 24 may be water, a gel or other material that may be effectively chilled and/or heated. The material or materials chosen should have a high specific heat or heat capacity in order to best cool and/or heat or maintain a low or a high temperature of fluid within the pouch 4. A preferred medium 24 for cooling comprises a non-toxic refrigerant gel of conventional formulation. Compositions that may be suitable for medium 24 include water and propylene glycol or a cellulose ether, those described in U.S. Pat. Nos. 5,035,122; 6,044,201 (and the references cited in each), those used/produced by Consolidated Products and Services, Inc. (Braintree, Mass.), or as used in commercially available gel packs for cooling and/or heating including Nexpare™ (3M: St. Paul, Minn.), PolyBag™ (Super Ice Corporation: San Leandro, Calif.).

The pouch variation shown in FIGS. 2A and 3A is advantageously formed by a plurality of heat-sealed or welded layers. A pair of layers provide for a fluid compartment 26 that accessed by cap 18 while another external layer forms each of pockets 22.

As referred to above, conduit 12 is preferably placed in fluid communication with the hydration pouch at or near its bottom to facilitate complete evacuation of its potable contents. The present invention is centrally concerned with the manner in which the conduit is hooked-up to the hydration pouch—regardless of its location.

FIG. 2A shows one manner of connection. It involves a fitting assembly 16 utilizing the components shown in enlarged view FIG. 2B. FIG. 2B details a preferred male coupling portion 28 and a female coupling portion 30. FIG. 3A shows another manner of connection. It involves a fitting assembly 16' utilizing the components shown in enlarged view FIG. 3B. FIG. 3B details another preferred male coupling portion 28' and a female coupling portion 30. The female coupling portions preferably include an internal check valve.

All of the coupling portions shown is a variation of those produced by Air-Oil Products Corp., (Pneumatic Group—Portland, Oreg.). Specifically, ¼ inch or 5/16 inch I.D. tubing size fittings in the "APC" or "PLC" product line are preferred. Primary valve components are preferably produced from plastic, such as Acetyl thermoplastic, but metal may be used, especially corrosion resistant metals, such as stainless steel. Plastic components are preferred for low cost, while offering acceptable durability.

In each fitting combination 32/32', fluid is able to pass freely through the members when they are engaged. When disengaged as shown, at least the portion of the coupling combination that is directly connected to the pouch is shut-off or closed-off to flow. It is possible, however, to configure either valve portion with manual valve-release features to allow a user to override valve closure function in order to drain fluid contents and/or purge air from the hose or pouch.

Depending of the valve configuration, either the male or female portion may be set on the bag-side of the combination. FIGS. 3A and 3B merely show two optional valve placement configurations. However, at minimum, a check valve is incorporated in the bag-side valve portion to seal off the contents of pouch 4 and prevent them from escaping when no hose is attached.

For the valves portions pictured, female valve body 30 preferably includes a depressable release lever 34 and associated internal locking mechanism so members 28/28' and 30 decouple only when desired. For connection to tubing 12, hose barb sections 36 are preferably used. Such ferrule less fitting are conveniently attached to any sort of semi-rigid or flexible tubing. Of course, other fitting end types may be employed.

With the male fitting portions shown, an optional O-ring seal 38 is provided to help avoid leakage between the male and female body portions when engaged. In the valve variation shown in FIG. 2B, the male valve portion includes a spring-loaded valve core 40 to alternately seal and open this valve portion to liquid flow. Generally, the valve core is depressed upon engaging the valve portions. When provided with its own valve assembly, male portion 28 is suitable for use adjacent pouch 4 as shown in FIG. 2A.

The complimentary female coupling portion shown in FIG. 2A may or may not include a check valve. It is convenient when it does include a valve since this will seal off any contents in line 12 to prevent their leakage therefrom.

In the configuration of the invention shown in FIG. 3A, male body portion 28' (detailed in FIG. 3B) is without a valve core 40 as shown in the variation in FIGS. 2A and 2B. It is always open to flow. As such, it does not ensure that contents of line 12 will not escape when the valve portions are disengaged. Still, liquid in the line will tend to remain intact by virtue of closure of valve 14—acting like a finger plugging the end of a straw. It may be desired to use a valve combination in which the line-side member does not include its own shutoff valve (whereas the bag-side portion still does as shown in FIG. 3A) in order to conserve costs.

Of course, other types or sizes of fittings or fitting portions may be employed in the present invention. What is of interest is a fitting assembly that can be easily connected and disconnected, always leaving an end in association with a pouch that serves as a check valve or shut-off valve preventing inadvertent drainage.

With respect to preferred embodiments of the invention shown, however, FIG. 2A illustrates a more integrated approach than that shown in FIG. 3A. It preferably achieves an integrated approach by directly connect an angle connector section 42 of connector portion 28 (or 30) to a pouch interface portion 44. The members may be connected using a press fit, a threaded interface or they may be otherwise connected—such as by providing the members in an integral piece. In any case, interface portion 44 (in variations of the invention shown in the figures) is preferably captured and welded to opposing layers of bladder 4 to form a fluid-tight seal around its periphery with the bag.

Regardless of the constructional details, valve assembly 16 in FIG. 2A is completed by pushing the member shown broken apart together. Conduit 12 remains attached to valve portion 30 in use, but the valve portions are easily engaged and disengaged as desired. Valve assembly 16' in FIG. 3A is similarly completed by pushing its respective members together.

The extension may take the form of an elbow joint or it may be straight. In point of fact, such members (or their equivalent) are included in typical hydrations pouches such as referenced above. Accordingly, a typical pouch may be transformed into one according to the present invention by inserting a valve combination 32 in-line with its existing hydration line as shown.

A user would simply cut the hose or line and press the fitting in place. Preferably the coupling is situated in close proximity/adjacent to the body of the pouch and its outlet. Whether the valve portions are used in a retrofit kit or not, a tubular bridge portion 48 is used in this variation of the invention to place the check-valve in fluid communication with the pouch exit fitting or extension section 46. The length of the bridge tubing may be varied as desired. Still it is preferably sized so less than about 3 inches of free tubing are provided between the ends of the coupling portions; more preferably, between 1 and 2 inches are provided. While the present invention encompasses different length extension sections, shorter ones will tend to kink, and longer ones not take full advantage of the convenience offered by more preferred designs. It may be connected to the pouch fitting utilizing hose barbs 50 or whatever other manner is convenient, including a hose clamp or otherwise.

Returning to FIG. 1, the functional value of being able to release and install a hydration pouch separate from a feed line or conduit 12 becomes apparent. Typically, the conduit is threaded from the inside of a bag or harness from the inside out as shown. It may pass through or be tied down by various members in order to confine its path while in use or for storage. The ability to detach pouch 4 from the hose can tremendously expedite bladder placement, change-out and hydration system preparation. Replacing a hydration bladder with a full one, or returning a filled bladder (neither one being connected to a capped hose or line in accordance with the present invention) to bag 2 is feasible due to the check-valve which keeps the bladders' contents intact without resort to holding it at an awkward angle or manually stopping any openings with a finger or the like.

Handling of a detached pouch 4 is improved over one attached to a hydration line in another respect. A detached pouch according to the present invention may be stored, refrigerated, warmed or filled without a user getting tangled in a lengthy piece of tubing. In addition, other advantages and uses may be apparent to one with skill in the art.

Though the invention has been described in reference to several examples, optionally incorporating various features, the invention is not to be limited to the set-ups described or indicated as contemplated with respect to each variation. It is to be understood that the breadth of the present invention is to be limited only by the literal or equitable scope of the following claims. That being said,

I claim:

1. A method of hydration comprising:

providing a hydration system comprising a flexible pouch, said pouch having an inlet and an outlet, said inlet being closeable with a cap, said outlet being in fluid communication with a hydration tube, wherein said hydration tube includes a user actuatable valve at a proximal end and a coupling distal thereto, said coupling comprising a first portion adjacent said pouch and a second portion, said first portion including a valve portion that is open when said coupling is engaged and sealed when said coupling is disengaged, filling said system with potable fluid with said first and second coupling disengaged, engaging said first and second coupling portions, and consuming fluid from said pouch, said pouch being in a flexible state during such consumption, wherein said flexible pouch is inserted in a pack prior to said engaging.

2. The method of claim 1, wherein following said consuming, said coupling is disengaged, said flexible pouch is removed from said pack, and said hydration tube is retained by said pack.

3. A method of making a hydration pouch with a detachable hose, said method comprising:

providing a hydration pouch with a hose, cutting said hose, and inserting a coupling where said hose was cut, said coupling comprising a first portion adjacent said pouch and a second portion, said first portion including a valve portion that is open when said coupling is engaged and sealed when said coupling is disengaged.

4. The method of claim 3, wherein said hose is cut at a location adjacent to said pouch.

5. The method of claim 3, wherein said second coupling portion includes a valve portion that is open when said coupling is engaged and sealed when said coupling is disengaged.

6. A hydration pouch conduit system comprising:

a hydration tube, a user actuatable valve, a coupling and a bridge tube, wherein said user actuatable valve is in fluid communication with a proximal end of said tube, wherein said coupling includes a first portion to be set in fluid communication with a hydration pouch and a second portion that is in fluid communication with a distal end of said tube, said first portion including a valve portion that is open when said coupling portions are engaged and sealed when said coupling portions are disengaged, and wherein said bridge tube is to be set in fluid communication between a hydration pouch and said first valve portion.

* * * * *